US005937763A

United States Patent [19]

Theurer

[11] Patent Number: 5,937,763

[45] Date of Patent: Aug. 17, 1999

[54] MACHINE AND METHOD OF DISTRIBUTING BALLAST

[75] Inventor: Josef Theurer, Vienna, Austria

[73] Assignee: Franz Plasser Bahnbaumaschinen-Industriegesellschaft m.b.H., Vienna, Austria

[21] Appl. No.: 08/819,389

[22] Filed: Mar. 17, 1997

[30] Foreign Application Priority Data

Apr. 23, 1996 [AT] Austria ..... 735/96

[51] Int. Cl.[6] ..... E01B 27/00

[52] U.S. Cl. ..... 104/2; 105/247; 105/240; 37/104

[58] Field of Search ..... 104/2, 12, 7.3; 105/239, 240, 247; 37/104, 105, 107; 222/504, 505, 509, 500, 533, 536; 171/16

[56] References Cited

U.S. PATENT DOCUMENTS

| | | | |
|---|---|---|---|
| 4,263,851 | 4/1981 | Theurer et al. | 104/2 |
| 4,770,104 | 9/1988 | Theurer | 37/104 |
| 4,794,862 | 1/1989 | Theurer | 37/104 |
| 5,052,132 | 10/1991 | Theurer et al. . | |
| 5,101,733 | 4/1992 | Mohr . | |
| 5,201,127 | 4/1993 | Whitaker | 104/2 |

FOREIGN PATENT DOCUMENTS

| | | |
|---|---|---|
| 0057128 | 8/1982 | European Pat. Off. . |
| 408 085 | 2/1996 | Switzerland . |
| 2036142 | 6/1980 | United Kingdom . |

*Primary Examiner*—Mark T. Le
*Attorney, Agent, or Firm*—Collard & Roe, P.C.

[57] ABSTRACT

A machine for distributing ballast on a ballast bed supporting a track comprises a machine frame supported on the track by undercarriages, the undercarriages having wheels making point contacts with the track and the contact points defining a reference plane, chutes arranged on the machine frame and spaced from each other in a direction extending transversely to the machine frame, each chute having a discharge end for downwardly discharging ballast, and a vertically adjustable wiper unit downwardly projecting from the discharge end of each chute towards the track and extending the chute. The wiper unit comprises a drive for adjusting the wiper unit relative to the discharge end, and defines an inlet opening associated with the discharge end of the chute and an outlet opening defining a wiper edge, the wiper edge extending parallel to the reference plane.

8 Claims, 2 Drawing Sheets

MACHINE AND METHOD OF DISTRIBUTING BALLAST

BACKGROUND OF THE INVENTION

1. Field of the Invention

The present invention relates to a machine and method for distributing ballast on a ballast bed supporting a track.

2. Description of the Prior Art

U.S. Pat. No. 5,052,132 discloses a ballast distributing and planing machine. The machine comprises a machine frame supported by undercarriages for movement along the track and is equipped with a ballast plow and a rotary broom. An elongated conveyor band leads from the broom to a ballast storage container which has a bottom conveyor band. A ballast discharge device is arranged to receive ballast from a discharge end of the bottom conveyor band. The ballast discharge device comprises four chutes spaced from each other in a direction extending transversely to the machine frame, and ballast discharge conveyors are affixed to the lower ends of the chutes. Each driven ballast discharge conveyor is pivotal about a vertical axis so that the ballast may be discharged at different sections of the track, as desired. The amount of the discharged ballast may be regulated by changing the driving speed of the ballast discharge conveyors.

A vertically adjustable wiper unit is arranged in the discharge range of each ballast discharge conveyor. It is comprised of a multiplicity of vertically extending rubber elements which form a kind of a curtain for sweeping discharged ballast from the tops of the track ties into the adjacent cribs. This lessens the amount of work to be done by the succeeding rotary broom which finishes the ballasting operation.

U.S. Pat. No. 4,794,862 and European patent No. 0 057 128 disclose ballast tamping machines carrying a ballast storage container with chutes that may be closed so that ballast, as needed, may be distributed on the track.

According to U.S. Pat. No. 5,101,733, ballast discharge chutes may be arranged in the range of the tamping tools of a ballast tamping machine. A conveyor band system conveys ballast to the chutes so that ballast be distributed in specific areas which require it.

Finally, British patent No. 2,036,142 discloses a ballast planing machine with a ballast storage container equipped with chutes for distributing ballast, as well as a rotary broom.

SUMMARY OF THE INVENTION

It is the primary object of this invention to provide a machine for uniformly distributing ballast on a ballast bed supporting a track, independent of the ballasting condition of the track.

This and other objects are accomplished according to the invention with a machine comprising a machine frame supported on the track by undercarriages for movement along the track in an operating direction, the machine frame extending in a longitudinal direction, the undercarriages having wheels making point contacts with the track and the contact points defining a reference plane, chutes arranged on the machine frame and spaced from each other in a direction extending transversely to the machine frame, each chute having a discharge end for downwardly discharging ballast, and a vertically adjustable wiper unit downwardly projecting from the discharge end of each chute towards the track and extending the chute. The wiper unit comprises a drive for adjusting the wiper unit relative to the discharge end, and defines an inlet opening associated with the discharge end of the chute and an outlet opening defining a wiper edge, the wiper edge extending parallel to the reference plane.

Such a wiper unit assures a uniform ballast distribution by selecting a constant distance of the wiper edge from the track ties. This is possible because an accumulation of ballast is always stored in the wiper unit so that the required amount of ballast for a uniform ballast distribution is discharged automatically even if the required amount varies because of different conditions of the ballast bed. The wiper edge forms a strip of ballast of uniform height, assuring, on the one hand, an effectively uniform ballast distribution, which provides a long-lasting track support, and safely excluding the distribution of excess ballast, on the other hand, in an economical manner. The arrangement has the additional advantage of a very simple construction.

According to another aspect of the present invention, the use of the machine provides a method of continuously distributing ballast on a ballast bed supporting a track comprising rails fastened to ties, comprising the steps of moving a machine frame supported on the track by undercarriages along the track in an operating direction, the machine frame extending in a longitudinal direction, the undercarriages having wheels making point contacts with the track and the contact points defining a reference plane, downwardly discharging ballast from discharge ends of chutes arranged on the machine frame and spaced from each other in a direction extending transversely to the machine frame, discharging ballast from the discharge end of each chute into an inlet opening of a vertically adjustable wiper unit downwardly projecting from the discharge end of each chute towards the track and extending the chute, and adjusting the wiper unit relative to the discharge end for accumulating sufficient ballast in the wiper unit to discharge permanently more ballast from an outlet opening of the wiper unit than is required for a desired ballast distribution on the ballast bed, and the outlet opening defining a wiper edge spaced from the track ties and the wiper edge extending parallel to the reference plane, and forming with the wiper edge a strip of ballast extending in the longitudinal direction and having a constant height relative to the track ties.

BRIEF DESCRIPTION OF THE DRAWING

The above and other objects, advantages and features of this invention will become more apparent from the following detailed description of certain now preferred embodiments, taken in conjunction with the accompanying drawing wherein.

DETAILED DESCRIPTION OF THE PREFERRED EMBODIMENTS

Figure 1:
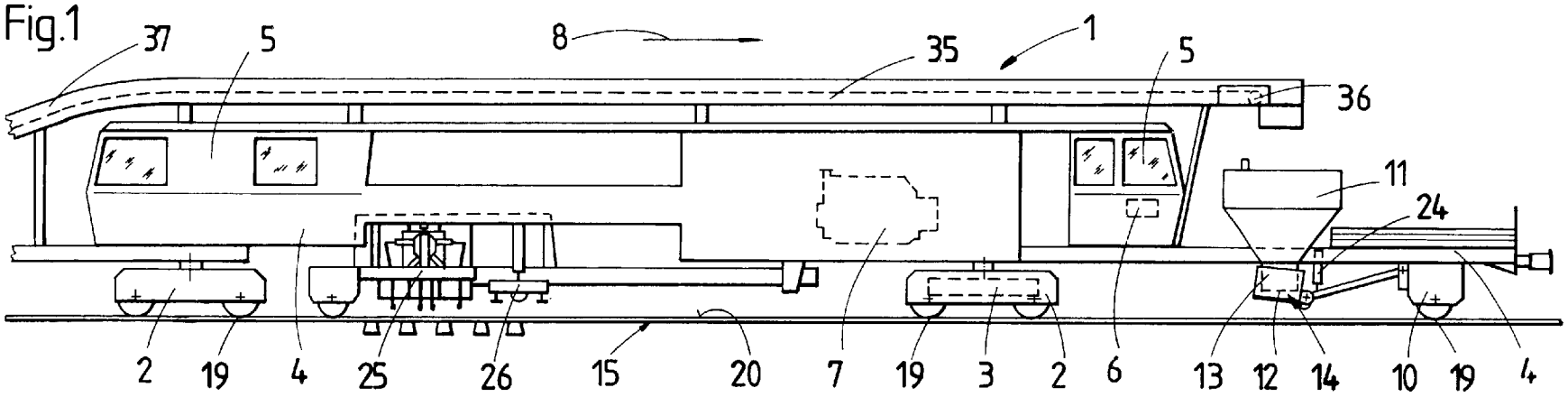
FIG. 1 is a side elevational, somewhat schematic view of a ballast tamping machine equipped with a ballast storage container with chutes for distributing ballast on a ballast bed supporting a track.

Referring now to the drawing, FIG. 1 shows machine 1 for distributing ballast on a ballast bed supporting track 15 comprised of rails 22 fastened to ties 28. The machine comprises machine frame 4 supported on the track by undercarriages 2 and 10 for movement along track 15 in an operating direction indicated by arrow 8. The machine frame extends in a longitudinal direction. Undercarriages 2, 10 have wheels making point contacts 19 with track 15 and the contact points define a reference plane 20. Machine frame 4 is comprised of two frame parts which are linked to each other and carries operator's cabs 5 housing control panel 6 and a motor 7. The machine frame is driven in the operating direction by drive 3.

As shown in FIG. 1, ballast tamping and track correction means comprising tamping heads 25 and track lifting and lining unit 26 are mounted on the rear frame part of machine frame 4 in the operating direction, a ballast storage container 11 is mounted ahead of the ballast tamping and track correction means 25, 26 on the front frame part of the machine frame in the operating direction, and an elongated conveyor band 35 is mounted on top of machine frame 4, the conveyor band having a discharge end positioned above ballast storage container 11 and an inlet end positioned at a rear end of the machine frame in the operating direction.

The ballast storage container arranged on machine frame 4 has chutes 13 spaced from each other in a direction extending transversely to the machine frame. Each chute 13 has a discharge end 12 for downwardly discharging ballast. An annular, vertically adjustable wiper unit 14 downwardly projects from discharge end 12 of chute 13 towards track 15 and extends the chute.

Figure 3:
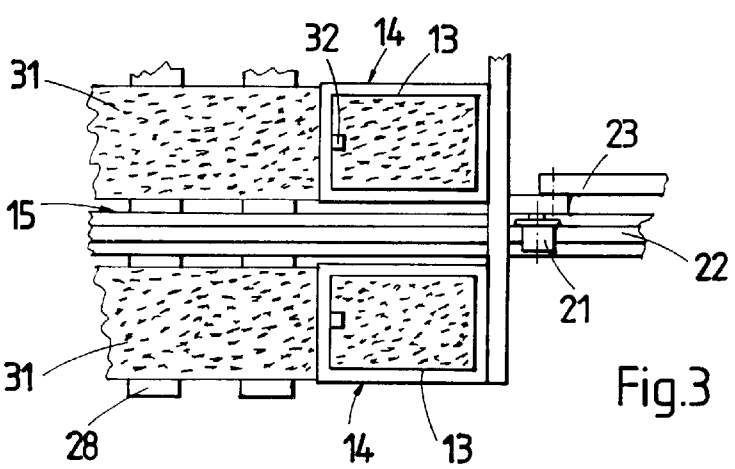
FIGS. 2 and 3 are, respectively, enlarged side and top views of the chutes with their wiper unit.
Figure 2:
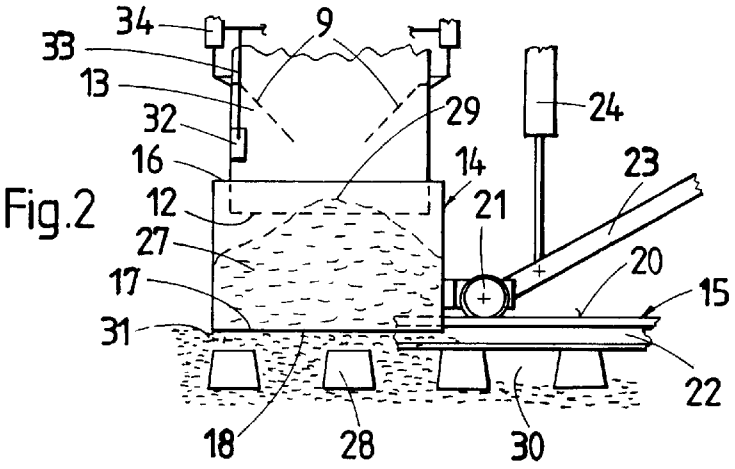

FIGS. 2 and 3 show wiper unit 14 in detail, the wiper units being illustrated in their lowered position, in contrast to FIG. 1 where they are shown in their raised position. The wiper unit comprises drive 24 for adjusting the wiper unit relative to discharge end 12 of chute 13, and defines an inlet opening 16 associated with the discharge end of the chute and an outlet opening 17 defining wiper edge 18. The wiper unit defines a chamber between inlet opening 16 and outlet opening 17 for ballast coming from discharge end 12 of chute 13 to accumulate. The wiper edge extends parallel to reference plane 20 in the lowered operating position.

As best shown in FIGS. 2 and 3, a rod 23 extends in the longitudinal direction and links wiper unit 14 to machine frame 4, and flanged roller 21 supports the wiper unit on track 15 in its lowered position. Vertical adjustment drive 24 enables wiper unit 14 to be vertically adjusted from a rest position shown in FIG. 1 to the lowered operating position shown in FIG. 2 so that wiper edge 18 may be suitably adjusted. As shown in FIG. 3, a pair of wiper units 14, forming a structural unit, is associated with each rail 22 of track 15 so that strips 31 of ballast are laid down at each side of the rail. To change the height of ballast strips 31, the vertical adjustment drive could also be arranged between flanged roller 21 and wiper unit 14 so that the wiper unit is vertically adjusted relative to the flanged roller.

In the use of machine 1 and while tamping the ballast and correcting the track position with tamping heads 25 and track lifting and lining unit 26, uniform ballast distribution in the ballast bed supporting track 15 is obtained by distributing ballast 27, if needed, over track ties 28 in the ballast bed. Machine frame 4 is supported on track 15 by undercarriages 2, 10 and moved along the track in the operating direction. Ballast 27 is downwardly discharged from discharge ends 12 of chutes 13, and the ballast is discharged from the discharge end of each chute into inlet opening 16 of vertically adjustable wiper unit 14. The wiper unit is adjusted relative to discharge end 12 by drive 24 for a sufficient ballast accumulation 29 in the annular wiper unit to discharge permanently more ballast from outlet opening 17 of the wiper unit than is required for a desired ballast distribution on the ballast bed. The outlet opening defining wiper edge 18 is spaced from track ties 28 at a constant distance of a few centimeters and the wiper edge to form with wiper edge 18 a strip of ballast 31 extending in the longitudinal direction and having a constant height relative to the track ties.

To maintain permanent ballast accumulation 29 in wiper unit 14, despite different ballast distribution requirements dependent on varying ballasting conditions in the ballast bed supporting track 15, a sonic altimeter 32 is associated with wiper unit 14 and senses the ballast accumulation. The sonic altimeter emits control signals corresponding to the sensed height of ballast accumulation 29, and adjustable damper 9 in chute 13 controls the cross section of each chute by operating adjusting drive 34 for the damper. Control circuit 33 transmits the control signals of sonic altimeter 32 to adjusting drive 34 whereby the cross section of the chute is controlled in response to the control signals of the sonic altimeter and ballast accumulation 29 in wiper unit 14 is kept at a constant amount, different amounts of distributed ballast being compensated automatically by corresponding repositioning of dampers 9. This causes cribs 30 automatically to be filled uniformly with ballast by the formation of ballast strips 31 of identical height.

Ballast storage container 11 may be kept filled with ballast by elongated overhead conveyor band 35 mounted on top of machine frame 4, the ballast being discharged from conveyor band outlet end 36 into the ballast storage container and being received at inlet end 37 at the rear end of machine frame 4, to which a ballast storage car may be coupled.

Machine 1 illustrated in FIGS. 1 to 3 may be used, for example, for correcting a track position after a ballast cleaning operation which removed detritus and distributed a reduced amount of cleaned ballast in the track. To obtain the desired height of the ballast bed and enable the ballast to be tamped properly under ties 28, the formation of strips 31 of ballast at the ends of the ties as well as between rails 22 (see FIG. 3) will assure a uniform ballast distribution. The controlled ballast discharge from wiper units 14 assures that only the required amount of ballast is distributed and no ballast is wasted.

Figure 4:
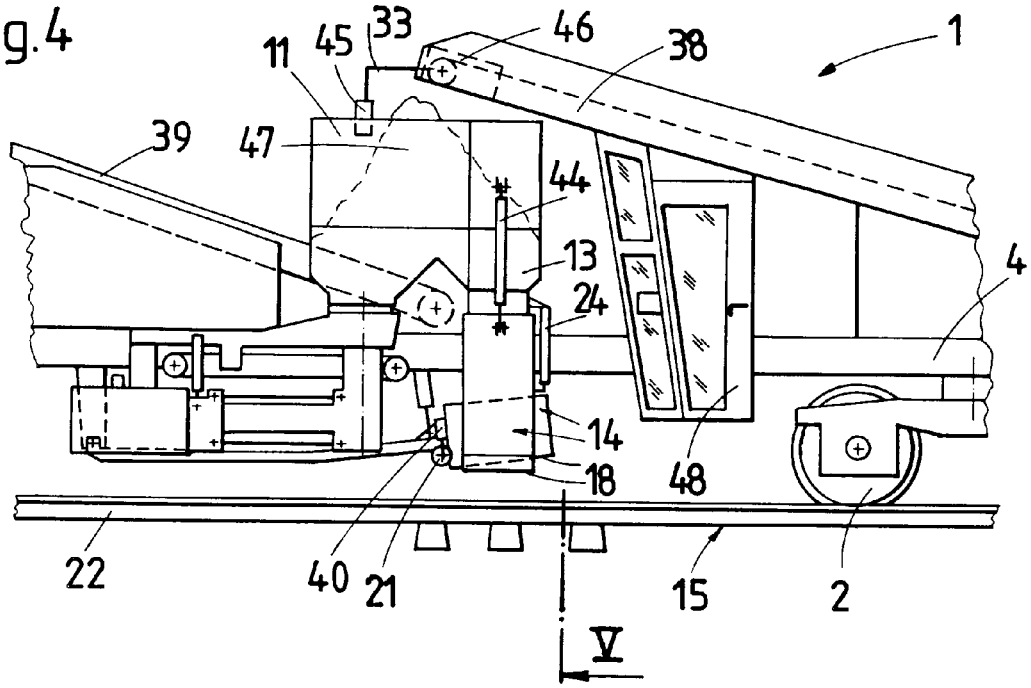
FIG. 4 is a fragmentary side view of another embodiment of a machine for distributing ballast.
Figure 5:
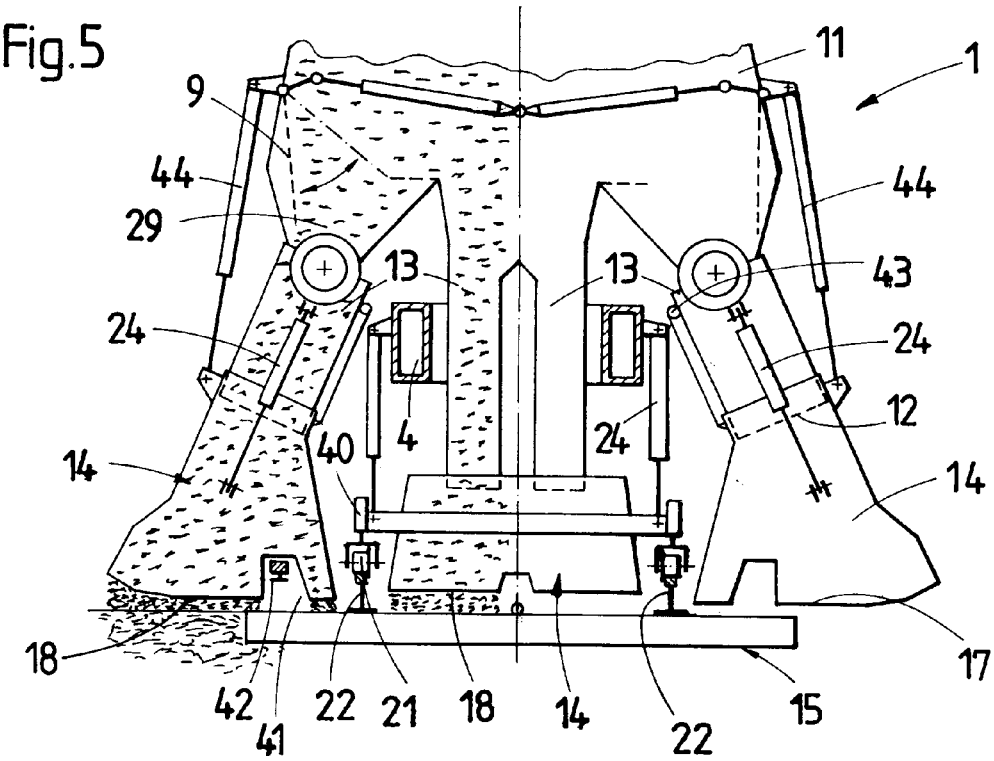
FIG. 5 is an enlarged end view, partly in section, taken in the direction of arrow V in FIG. 4.

In FIGS. 4 and 5, like reference numerals designate like parts functioning in a like manner so as to avoid redundancy in the description. In this machine, ballast storage container 11 is mounted more or less centrally between undercarriages 2. The ballast storage container is fed by a first conveyor band 38 extending in the longitudinal direction while a second conveyor band 39 extending partially underneath a discharge opening of ballast storage container 11 may remove ballast therefrom to a ballast cleaning machine (not shown). The ballast storage container has four chutes 13 spaced from each other in the transversely extending direction, two outer chutes at the track shoulders being associated with respective wiper units 14 while a common wiper unit 14 is associated with the two inner chutes centered between rails 22 and is supported on the rails by flanged rollers 21. The flanged rollers may be vertically adjusted relative to wiper unit 14 by drive 40 so that wiper edge may be spaced at a desired distance from the track ties by an operator in cab 48.

Outer wiper units 14 at the field sides of rails 22 define tunnels 41 extending in the longitudinal direction to prevent ballast from being distributed over power rails 42. A measuring instrument 43 is arranged for measuring the distance between chute 13 and wiper edge 18 determined by the vertical adjustment of the wiper unit relative to the chute by drive 24. Drives 44 are connected to the outer chutes for moving the chutes with t he wiper units in a direction extending transversely to the machine frame.

Control flaps 9 in the chutes are completely opened during the ballast distribution so that ballast accumulations 29 forms a ballast column reaching into the ballast stored in storage container 11. (For a clearer illustration, the ballast has been shown in FIG. 5 only in the left half of the figure.)

Sonic altimeter 45 in ballast storage container 11 is connected by control circuit 33 with drive 46 of first conveyor band 38 and controls the drive so that ballast accumulation 47 in the storage container remains constant, independent of the ballast removal by second conveyor band 39 or by chutes 13.

What is claimed is:

1. A machine for distributing ballast on a ballast bed supporting a track, comprising (a) a machine frame supported on the track by undercarriages for movement along the track in an operating direction, the machine frame extending in a longitudinal direction, the undercarriages having wheels making point contacts with the track and the contact points defining a reference plane, (b) chutes arranged on the machine frame and spaced from each other in the direction extending transversely to the machine frame, each chute having (1) a discharge end for downwardly discharging ballast, (c) a vertically adjustable wiper unit downwardly projecting from the discharge end of each chute towards the track and extending the chute, the wiper unit (1) comprising a drive for adjusting the wiper unit relative to the discharge end, and (2) defining an inlet opening associated with the discharge end of the chute and an outlet opening defining a wiper edge, the wiper edge extending parallel to the reference plane, and (d) a flanged roller supporting the wiper unit on the track.

2. The ballast distributing machine of claim 1, further comprising a measuring instrument for measuring the distance between the chute and the wiper edge.

3. The ballast distributing machine of claim 1, further comprising a sonic altimeter associated with the wiper unit and emitting control signals, an adjustable damper for controlling the cross section of each chute, an adjusting drive for the damper, and a control circuit transmitting the control signals of the sonic altimeter to the adjusting drive whereby the cross section of the chute is controlled in response to the control signals of the sonic altimeter and ballast accumulation in the wiper unit is kept at a constant amount.

4. The ballast distributing machine of claim 1, further comprising drive means connected to the chutes for moving the chutes with the wiper unit in a direction extending transversely to the machine frame.

5. The ballast distributing machine of claim 1, further comprising ballast tamping and track correction means mounted on the machine frame, a ballast storage container mounted ahead of the ballast tamping and track correction means on a front end of the machine frame in the operating direction, and an elongated conveyor band mounted on top of the machine frame, the conveyor band having a discharge end positioned above the ballast storage container and an inlet end positioned at a rear end of the machine frame in the operating direction.

6. The ballast distributing machine of claim 1, further comprising a rod extending in the longitudinal direction and linking the wiper unit to the machine frame.

7. The ballast distributing machine of claim 1, further comprising a vertical adjustment drive for adjusting the wiper edge, the vertical adjustment drive being arranged between the flanged roller and the wiper unit.

8. The ballast distributing machine of claim 1, comprising four of said chutes spaced from each other in the transversely extending direction, two outer chutes being associated with respective wiper units while a common one of the wiper units is associated with two inner chutes centered in the track, flanged rollers supporting the common wiper unit on the track, and a drive for vertically adjusting the flanged rollers relative to the common wiper unit so that the wiper edge may be spaced at a desired distance from the track.

* * * * *